US006086416A

United States Patent [19]

Choy

[11] Patent Number: 6,086,416

[45] Date of Patent: Jul. 11, 2000

[54] SECUREMENT ARRANGEMENT FOR SLANTED TYPE CARD EDGE CONNECTOR

[75] Inventor: Edmond Choy, Union City, Calif.

[73] Assignee: Hon Hai Precision Ind. Co., Ltd., Taipei Hsien, Taiwan

[21] Appl. No.: 09/016,144

[22] Filed: Jan. 30, 1998

[51] Int. Cl.[7] ..... H01R 13/60

[52] U.S. Cl. ..... 439/567; 439/570

[58] Field of Search ..... 439/563–565, 439/570, 567, 350, 351, 108, 83, 571

[56] References Cited

U.S. PATENT DOCUMENTS

| | | | |
|---|---|---|---|
| 5,230,638 | 7/1993 | DiViestu | 439/571 |
| 5,297,966 | 3/1994 | Brennian, Jr. et al. | 439/570 |
| 5,387,115 | 2/1995 | Kozel et al. | 439/328 |
| 5,425,651 | 6/1995 | Thrush et al. | 439/326 |
| 5,630,730 | 5/1997 | Wang et al. | 439/567 |
| 5,779,494 | 7/1998 | Ito et al. | 439/328 |

*Primary Examiner*—Gary F. Paumen
*Assistant Examiner*—Briggitte R. Hammond

[57] ABSTRACT

A slanted type card edge connector (10) includes an insulative housing (12) defining a central slot (14) for receiving a module therein. Two rows of contacts (18, 19) are provided by two sides of the central slot (14) with tails (20) extending horizontally out of the front surface (22) and the rear surface (24) of the housing (12). The housing (12) includes three securement sections (30) respectively essentially positioned on two opposite ends and the middle portion. A pair of mounting pads (46) and a positioning holdown (38) are provided with each securement section (30) wherein one mounting pad (46) extends horizontally and forward out of the front surface (22) of the housing (12) and the other mounting pad (46) extends horizontally and rearward out of the rear surface (24) of the housing (12) while the holdown (38) extending downward, thus resulting in a condition that the positioning holdown (38) is generally positioned between the corresponding front side mounting pad (46) and rear side mounting pads (46) and substantially keeps the same distance with regard to such two mounting pads (46). Therefore, such pair of mounting pads (46) cooperating with the center holdown (38) can provide a counterbalance with each other for efficiently resisting severe unusual insertion or withdrawal of the card with regard to the connector (10).

12 Claims, 10 Drawing Sheets

SECUREMENT ARRANGEMENT FOR SLANTED TYPE CARD EDGE CONNECTOR

BACKGROUND OF THE INVENTION

1. Field of The Invention

The invention relates to slanted type card edge connectors, and particularly to the slanted type connector having surface mount type contact tails and the corresponding securement device for mounting to the mother board.

2. The Related Art

The copending Ser. No. 08/910,376 filed Aug. 13, 1997 discloses a 25-degree slanted type DIMM (Dual In-line Memory Module) card edge connector with two rows of SMT (Surface Mount Technology) type contacts by two sides, wherein three solder pads are disposed on the front side cooperating with three post for securing the connector on the mother board. Anyhow, one concern has been raised whether the securement is sufficient to resist the bending moment, which is generated by insertion or withdrawal of the module or card with regard to the connector, imposed on rear side portions of the connector with the mother board. In such practice, apparently no reliable securement device is provided on the rear side of the connector to resist the bending moment imposed thereon.

Therefore, an object of the invention is to provide a slanted type card edge connector with the securement device on both front and rear sides for not only efficiently resisting the bending moment imposed thereabout, but also for reliably protecting the horizontally extending SMT type contact tails during delivery.

SUMMARY OF THE INVENTION

According to an aspect of the invention, a slanted type card edge connector includes an insulative housing defining a central slot for receiving a module or a card therein. Two rows of contacts are provided by two sides of the central slot with solder tails extending horizontally out of the front surface and the rear surface of the housing. The housing includes three securement sections respectively essentially positioned on two opposite ends and the middle portion. A pair of mounting pads and a positioning hold-down are provided with each securement section wherein one mounting pad extends horizontally and forward out of the front surface of the housing and the other mounting pad extends horizontally and rearward out of the rear surface of the housing while the hold-down extending downward, thus resulting in a condition that the positioning hold-down is generally positioned between the corresponding front side mounting pad and rear side mounting pads and substantially keeps the same distance with regard to such two mounting pads. Therefore, such pair of mounting pads cooperating with the center holdown can provide a counterbalance with each other for efficiently resisting severe unusual insertion or withdrawal of the card with regard to the connector.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
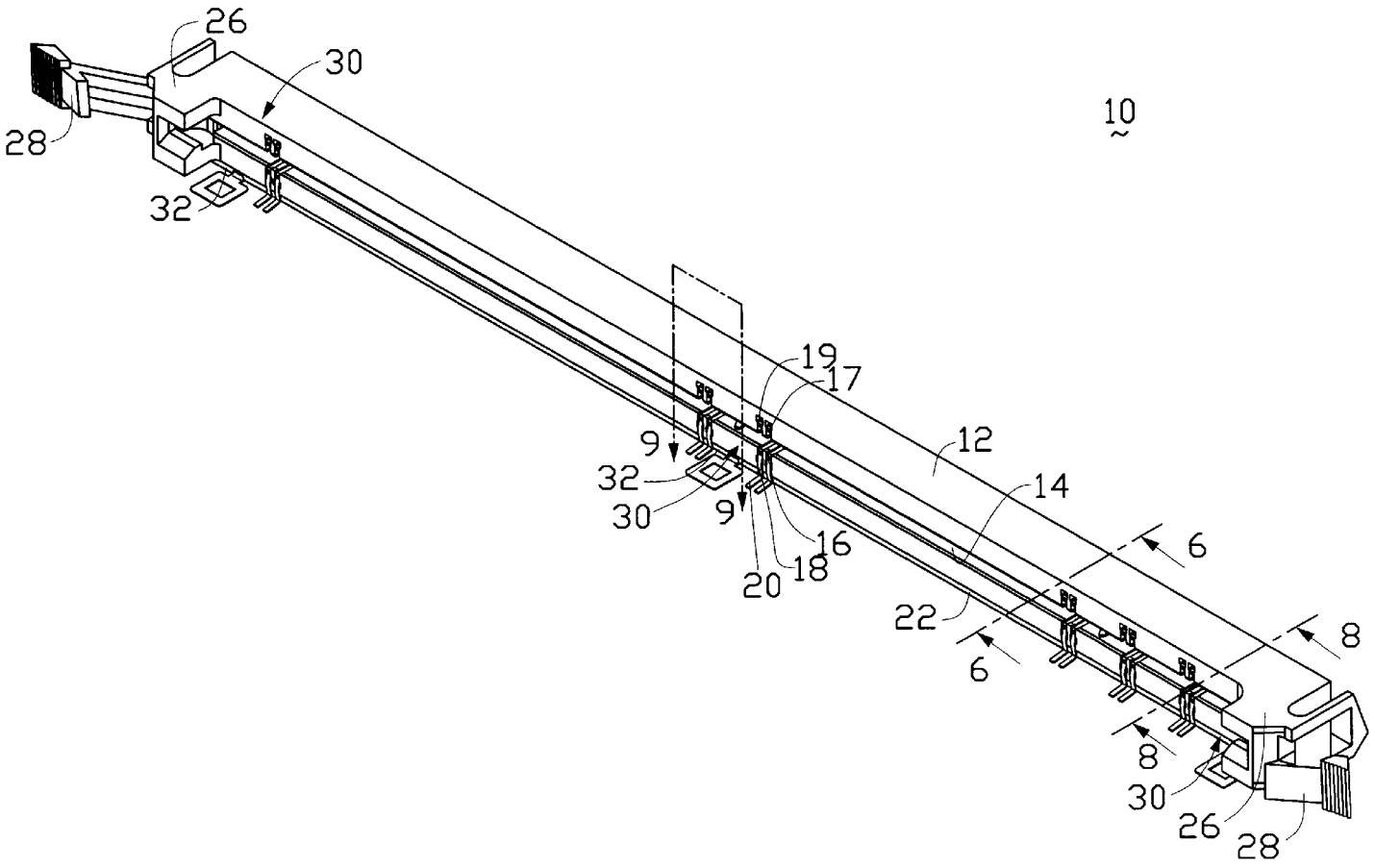
FIG. 1 is a front perspective view of a presently preferred embodiment of a slanted type DIMM connector according to the invention.
Figure 2:
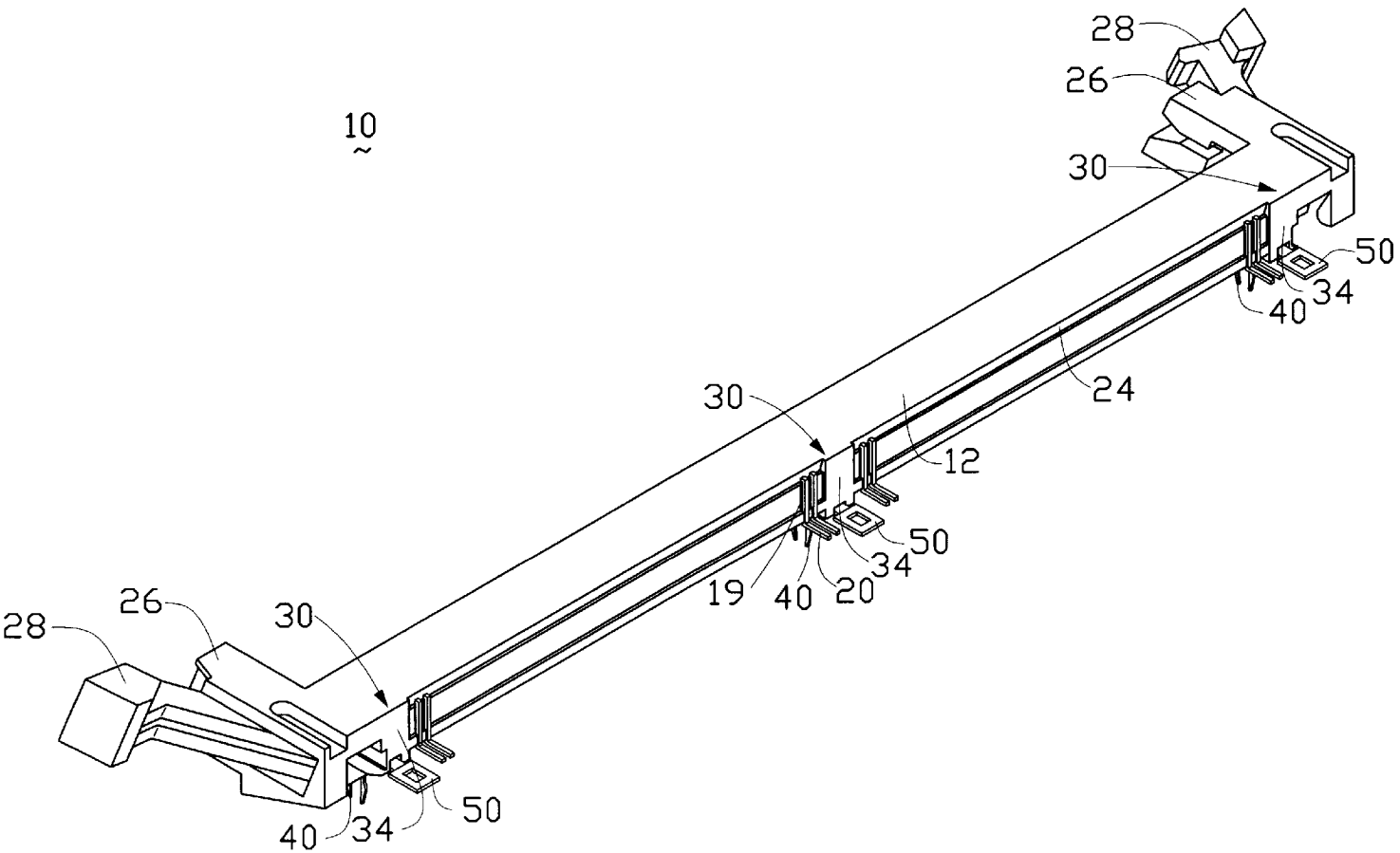
FIG. 2 is a rear perspective view of the slanted type DIMM connector of FIG. 1.
Figure 3:
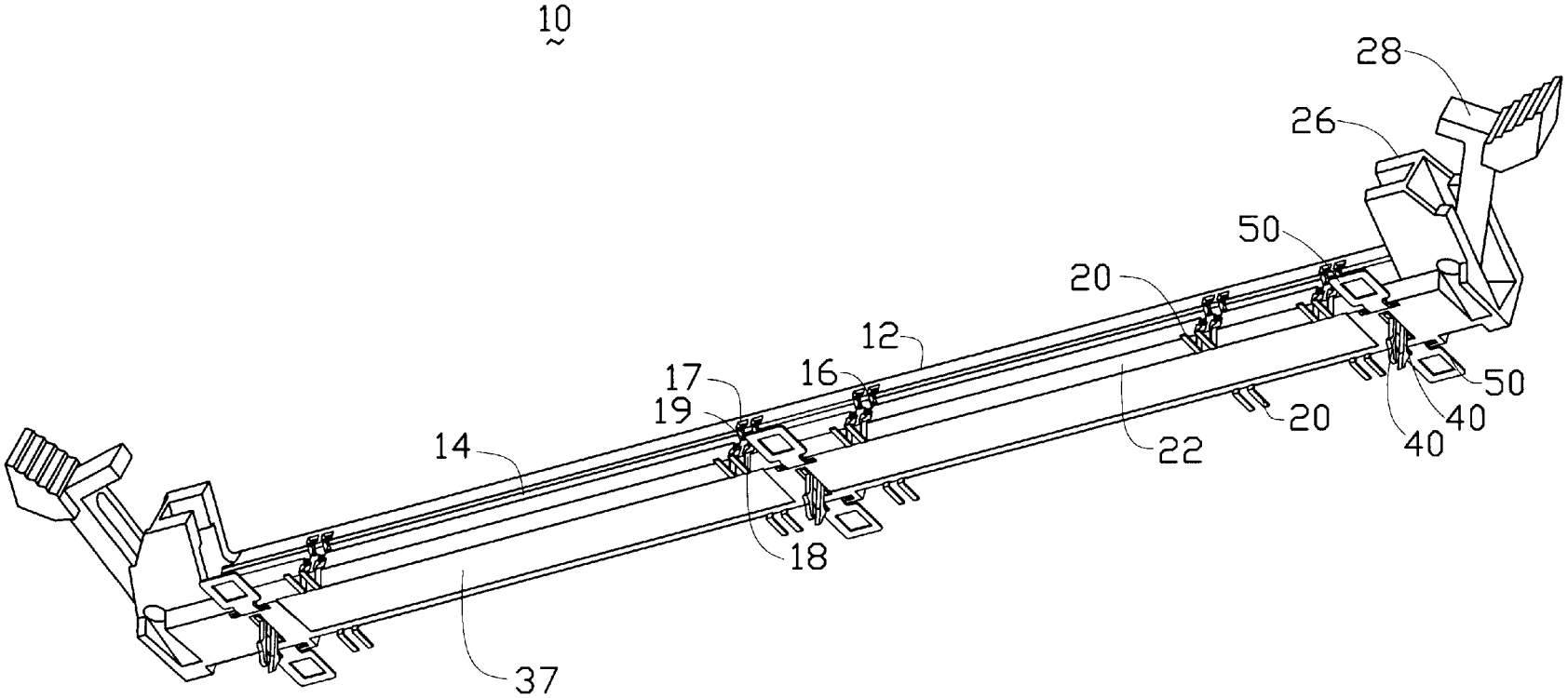
FIG. 3 is a bottom perspective view of the slanted type DIMM connector of FIG. 1.
Figure 4:
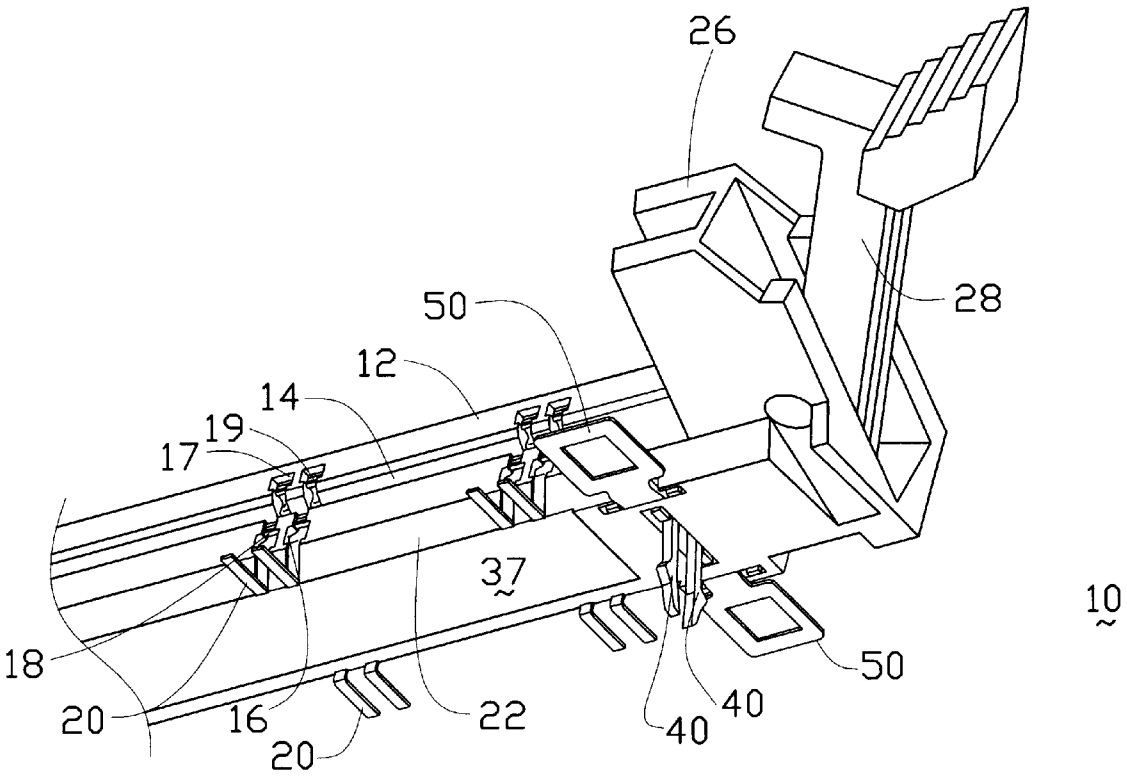
FIG. 4 is a partial enlarged bottom perspective view of the slanted type DIMM connector of FIG. 1.
Figure 5:
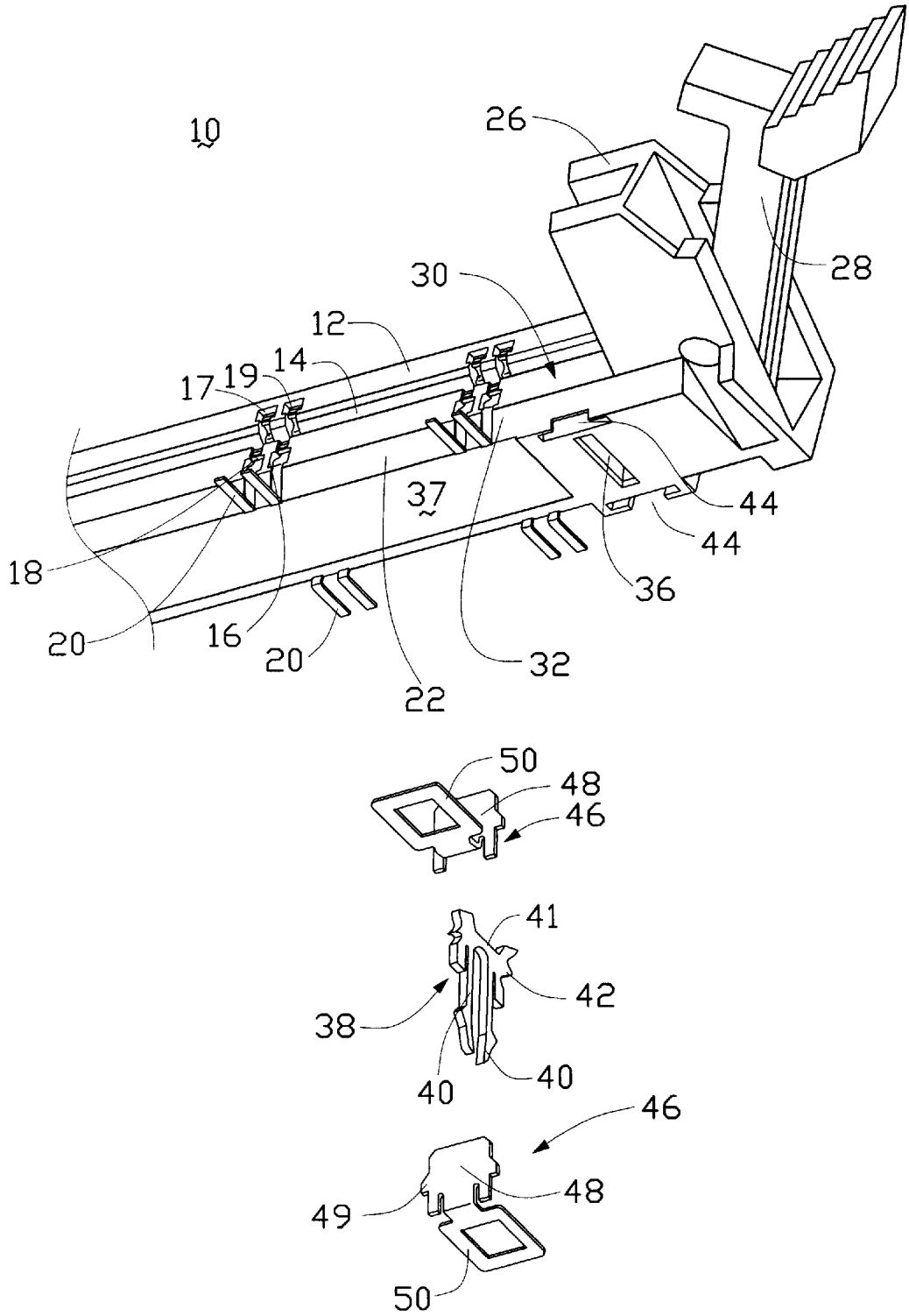
FIG. 5 is a partial enlarged bottom perspective view of the slanted type DIMM connector of FIG. 1 wherein the hold-down and the mounting pads are disassembled therefrom.
Figure 6:
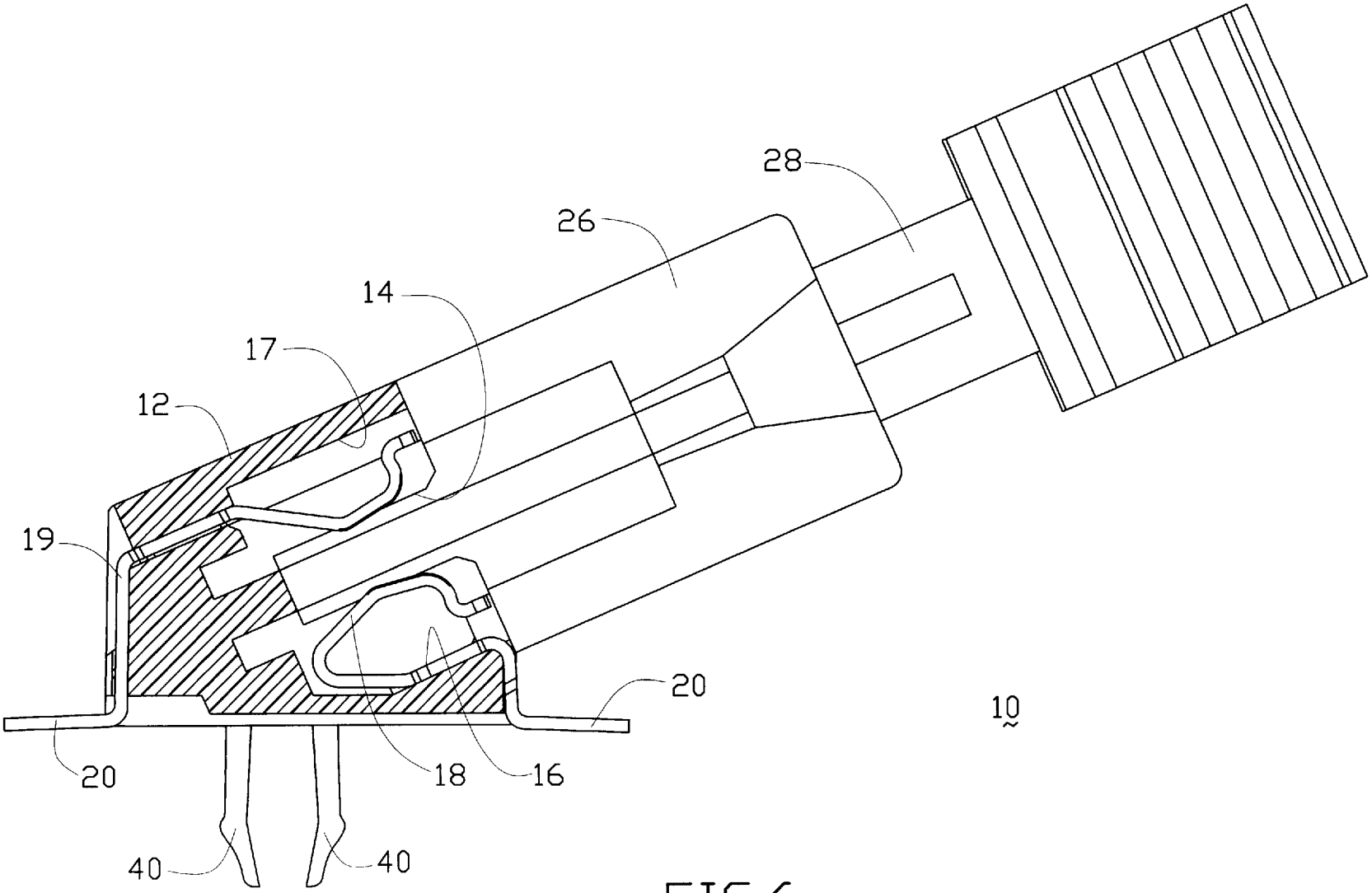
FIG. 6 is a cross-sectional view of the slanted type DIMM connector of FIG. 1 along line 6—6.
Figure 7:
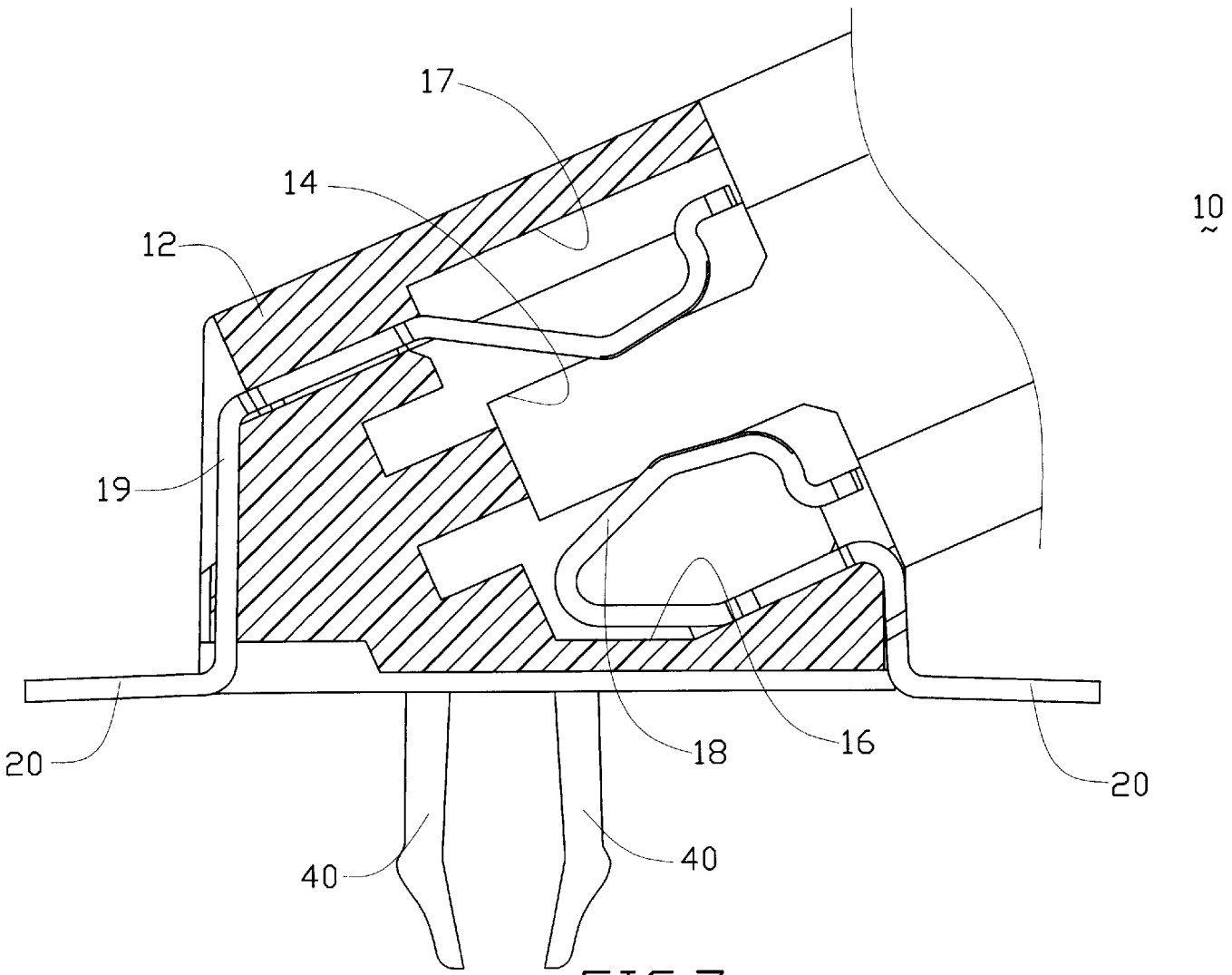
FIG. 7 is a partial enlarged cross-sectional view of the slanted type DIMM connector of FIG. 1 along line 6—6.
Figure 8:
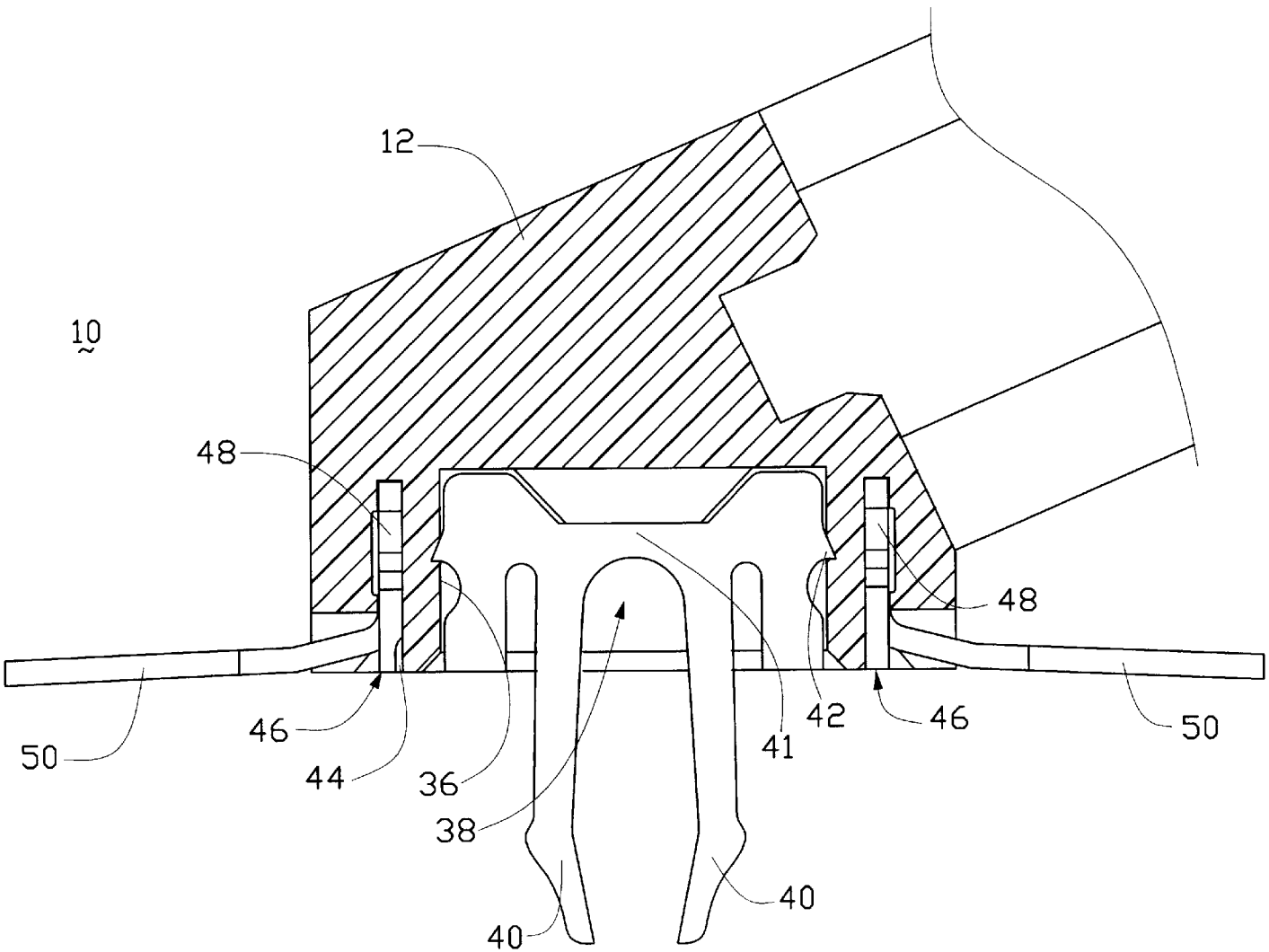
FIG. 8 is a partial enlarged cross-sectional view of the slanted type DIMM connector of FIG. 1 along line 8—8.
Figure 9:
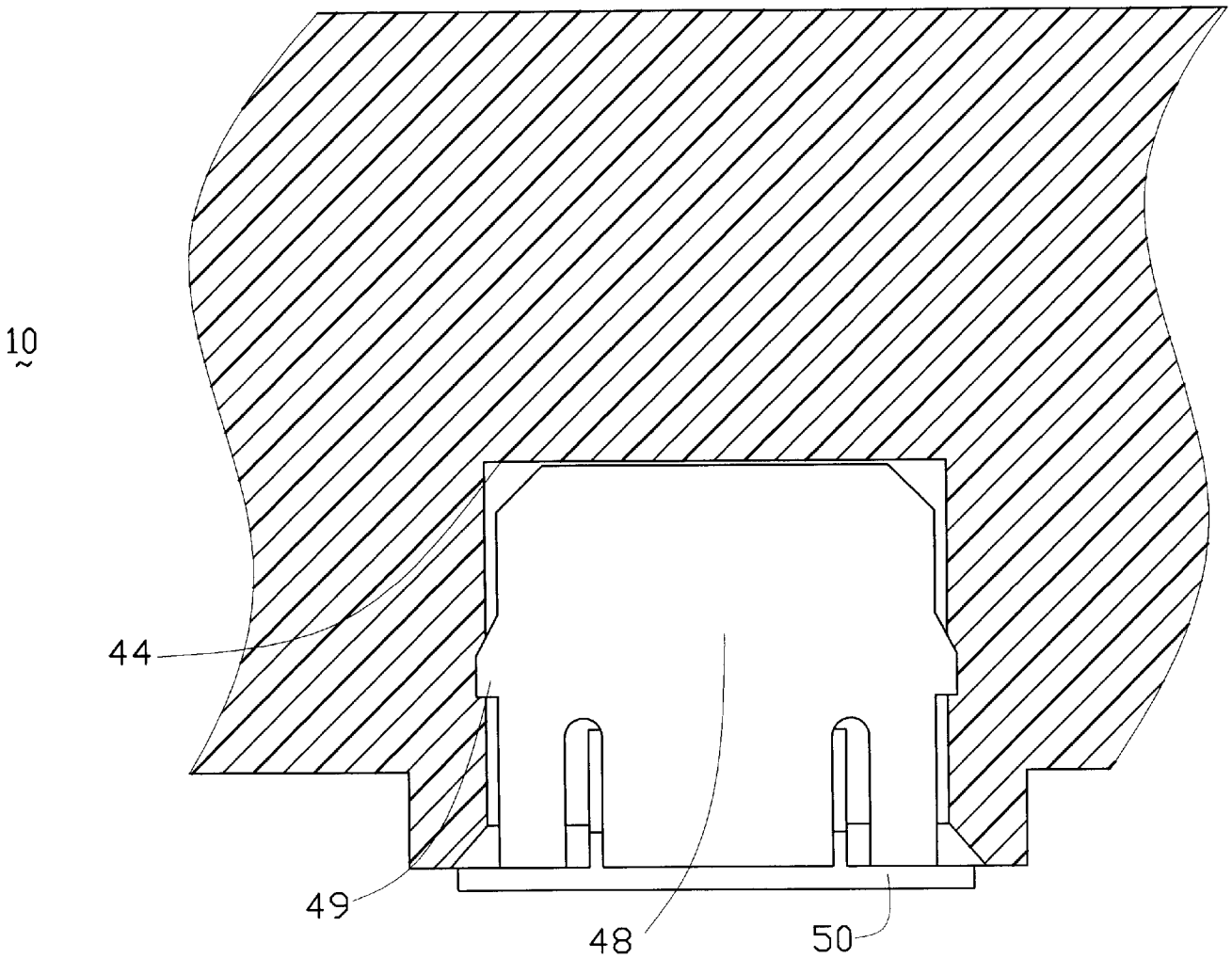
FIG. 9 is a partial enlarged cross-sectional view of the slanted type DIMM connector of FIG. 1 along line 9—9.
Figure 10:
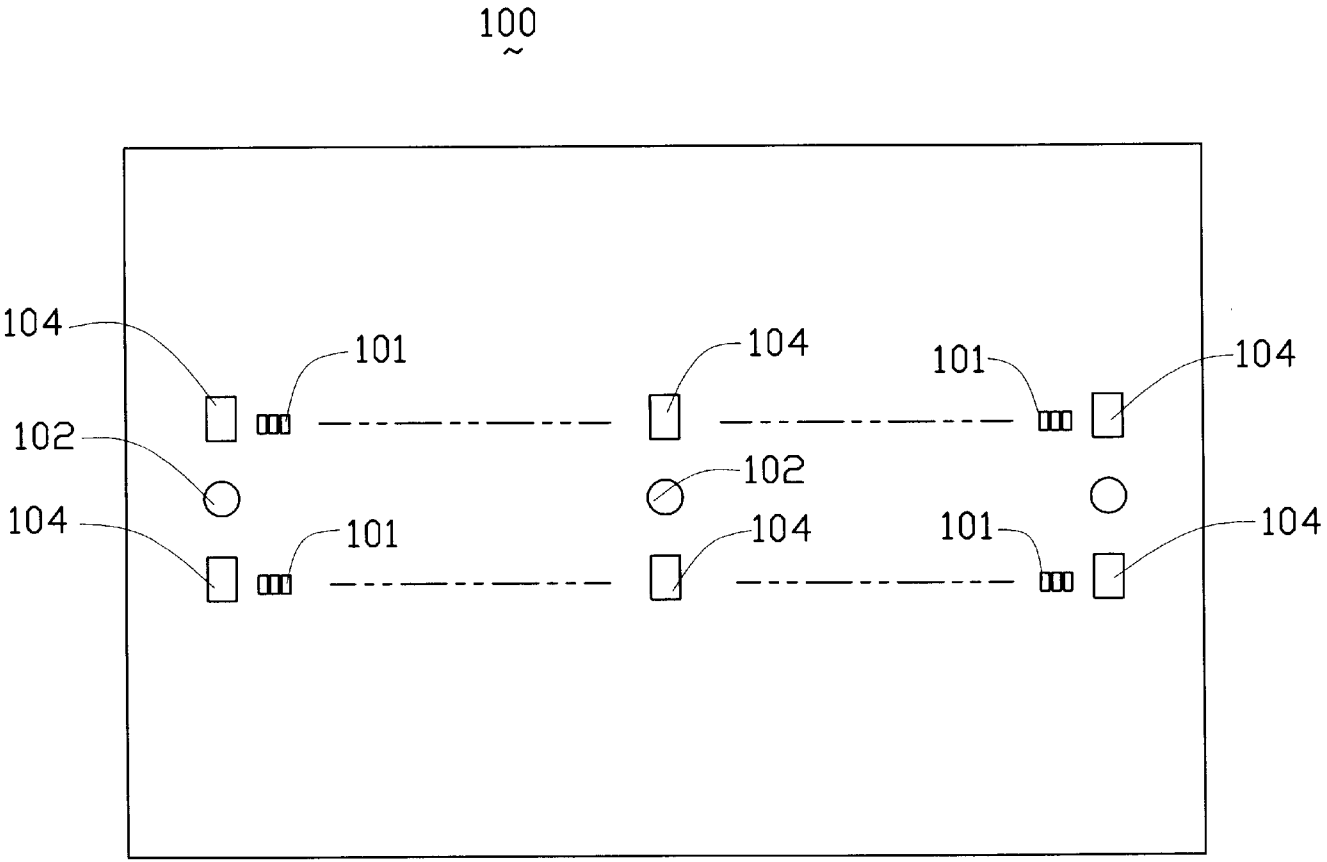
FIG. 10 is a plan view of a mother board on which the connector of FIG. 1 is adapted to be seated.

It will be noted here that for a better understanding, most of like components are designated by like reference numerals throughout the various figures in the embodiments. Attention is directed to FIGS. 1–5 wherein a 25-degree slanted type DIMM connector 10 includes an insulative housing 12 defining a central slot 14 for receiving a card therein. Two rows of cavities 16, 17 (also FIG. 6) are disposed by two sides of the central slot 14 for receiving a corresponding number of contacts 18, 19 therein. Each contact 18, 19 includes a SMT type solder tail 20 extending out of the front/rear surface 22/24 for mounting to the corresponding trace 101 of the mother board 100 (FIG. 10) on which the connector 10 is seated.

A pair of tower 26 are provided at two ends of the housing 12 for respectively receiving a pair of ejectors 28 therein, which perform a ejection or locking function with regard to the card.

The housing 12 further includes three securement sections 30 positioned respective near two opposite tower 26 and the middle portion of the housing 12. Each securement section 30 has a front face 32 and a rear face 34 which are respectively coplanar with the front surface 22 and the rear surface 24. Also referring to FIGS. 6–10, each securement section 30 includes a center aperture 36 extending upward from the bottom surface 37 in a front-to-end direction for receiving a metal hold-down 38 therein. The hold-down 38 includes a base 41 with barbs 42 thereof for interferential engagement within the aperture 36, and a pair of resilient legs 40 for receipt within the corresponding hole 102 in the mother board 100. Each securement section 30 further includes a pair of apertures 44 extending upward from the bottom surface 37 and by two sides of the center aperture 36 for respectively receiving therein a pair of mounting pads 46 wherein each mounting pad 46 includes a vertical retaining section 48 with barbs 49 thereon for interferential engagement within the corresponding aperture 44, and a horizontal solder section 50 for soldering unto the corresponding trace 104 on the mother board 100.

It can be seen that the solder sections 50 of each pair of mounting pads 46 extend respectively out of the front surface 22 and the rear surface 24 and essentially spaced from the legs 40 of the hold-down 38 with substantially an equal distance, thus providing a counterbalance with each other for efficiently resisting any forces, impact or bending moment imposed either on the front side or on the rear side of the housing 12.

Additionally, different from the aforementioned copending application which discloses three enlarged mounting sections on two opposite ends and the middle portion along the housing 12, the securement sections 30 of the housing 12 of the invention keep the same contour dimensions with the main portions of the housing 12 wherein the front face 32 and the rear face 34 of the securement sections 30 are coplanar with the front surface 22 and the rear surface 24 of the housing 12. Under this condition, the outward extending solder sections 50 of the mounting pad 46 should outward protrude not only out of the corresponding front/rear surface 22, 24, but also further out of the imaginary boundary line formed by the tips of the contact solder tails 20 along the same row for preventing damage due to any impact along the lengthwise direction.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

I claim:

1. A slanted type card edge connector comprising:

an insulative housing defining a central slot for receiving a card therein, and further defining a front surface, a rear surface and a bottom surface;

a plurality of contacts positioned by two sides of said central slot, each of said contact including a solder tail horizontally and outwardly extending out of either the front surface or the rear surface;

at least one securement section provided proximate to one end of the housing, said securement section including a pair of mounting pads having respective horizontally and outwardly extending solder sections respectively protruding out of the front surface and the rear surface said mounting pads having an aperture extending vertically therethrough to allow solder to be received therein.

2. The connector as defined in claim 1, wherein said securement section has a front face generally in coplanarity with the front surface of the housing, and a rear face generally in coplanarity with the rear surface.

3. The connector as defined in claim 1, wherein said solder section of the mounting pad extends substantially out of an imaginary boundary line formed by tips of the solder tails of the contacts of a same row.

4. The connector as defined in claim 1, wherein two towers are positioned at the end of the housing and by the securement section for receiving a pair of ejectors therein.

5. The connector as defined in claim 1, wherein three securement sections are provided along the housing about the two opposite ends and a middle portion thereof, respectively.

6. The connector as defined in claim 1, wherein said securement section further includes a downward extending hold-down generally positioned in alignment with an(i between said pair of solder pads.

7. The connector as defined in claim 6, wherein said hold-down is substantially positioned at a midpoint with regard to said pair of mounting pads.

8. A connector comprising:

an elongated insulative housing defining a front surface and a rear surface, said housing including a plurality of contacts with SMT type solder tails horizontally extending out of either the front surface or the rear surface; and at least one securement section positioned adjacent one end of the housing, said securement section providing a pair of mounting pads with a corresponding pair of horizontally extending solder sections respectively extending out of the front surface and the rear surface said mounting pads having an aperture extending vertically therethrough to allow solder to be received therein.

9. The connector as defined in claim 8, wherein said securement section defines a front face in coplanarity with the front surface of the housing and a rear face in coplanarity with the rear surface of the housing.

10. The connector as defined in claim 8, wherein the solder section of the mounting pad protrudes outward beyond tips of the solder tails of the contacts on a same side of the housing.

11. The connector as defined in claim 8, wherein said securement section further includes a vertical downward extending hold-down in align with and between said pair of solder sections of he mounting pads.

12. The connector as defined in claim 11, wherein said hold-down is generally positioned at a midpoint between said pair of solder sections of the mounting pads.

* * * * *